US005666750A

United States Patent [19]

Segan et al.

[11] Patent Number: 5,666,750

[45] Date of Patent: Sep. 16, 1997

[54] DECORATIVE ARTICLE WITH FLAKE CIRCULATING MEANS

[75] Inventors: Marc H. Segan, New York; Gary Strauss, Mamaroneck, both of N.Y.

[73] Assignee: M.H. Segan Limited Partnership, Great Barrington, Mass.

[21] Appl. No.: 450,422

[22] Filed: May 25, 1995

[51] Int. Cl.[6] ..... G09F 19/00

[52] U.S. Cl. ..... 40/410; 40/414; 446/236; 446/267

[58] Field of Search ..... 40/406, 409, 410, 40/414, 411; 446/236, 267

[56] References Cited

U.S. PATENT DOCUMENTS

| | | | |
|---|---|---|---|
| 2,587,620 | 3/1952 | Hormann . | |
| 4,641,445 | 2/1987 | Rossi . | |
| 4,869,005 | 9/1989 | Valentino . | |
| 4,923,721 | 5/1990 | Gilmore . | |
| 4,939,859 | 7/1990 | Bradt | 40/406 |
| 4,989,120 | 1/1991 | Davis et al. . | |
| 5,200,239 | 4/1993 | Chen . | |
| 5,261,848 | 11/1993 | Kaplan et al. . | |
| 5,291,674 | 3/1994 | Torrence | 40/410 |
| 5,301,444 | 4/1994 | Horiuchi | 40/406 X |
| 5,313,727 | 5/1994 | Murray, Jr. . | |
| 5,416,995 | 5/1995 | Teng | 40/409 X |
| 5,442,869 | 8/1995 | McDarren et al. | 40/406 |

OTHER PUBLICATIONS

Commercially available device sold under the name "Krystal Princess", U.S. Patent Pending, see attached photograph and concise explanation of relevance.

*Primary Examiner*—Brian K. Green

*Attorney, Agent, or Firm*—Cohen, Pontani, Liebeman & Pavane

[57] ABSTRACT

Ornamental display device for simulating snowfall over a display object or scene positioned within a housing comprises a liquid filled compartment rotatably arranged within the housing. The compartment includes first and second opposed sidewalls having aligned transparent portions defining a sealed interior cavity for receiving the liquid. The liquid within the cavity is substantially transparent and a plurality of snow-simulating flake particles are dispersed within the liquid. Blade members radially arranged within the compartment are oriented at a predetermined angle so as to transport flake particles from the lower zone of the cavity to the upper zone as the compartment is rotated. The transparent sidewall portions are aligned with the display object or scene so that the object or scene can be viewed during continuous recirculation of the flake particles.

26 Claims, 6 Drawing Sheets

FIG. 8
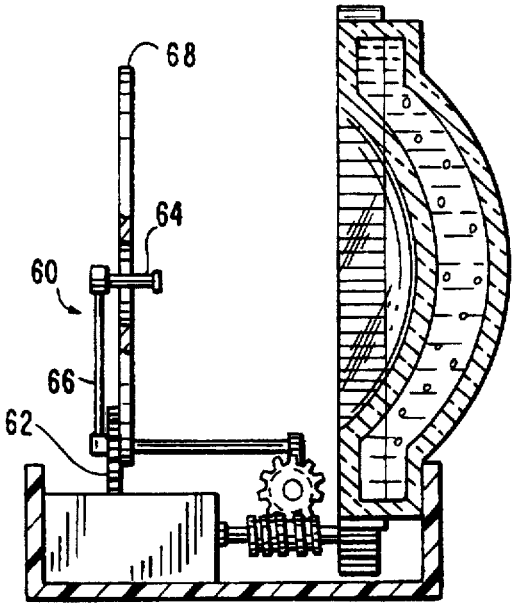
FIG. 9
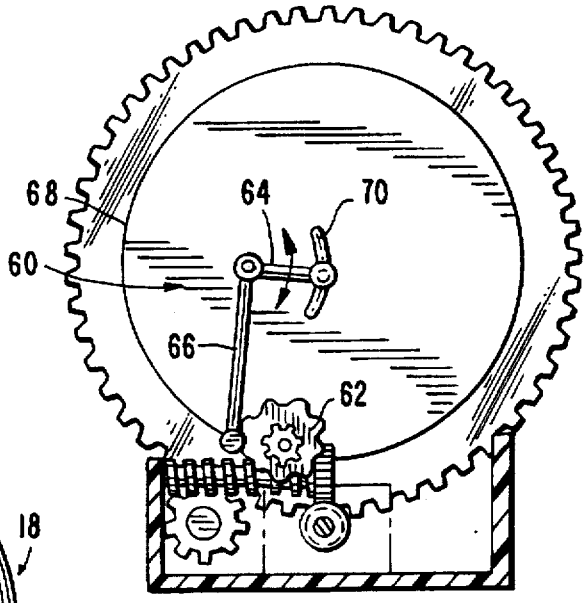
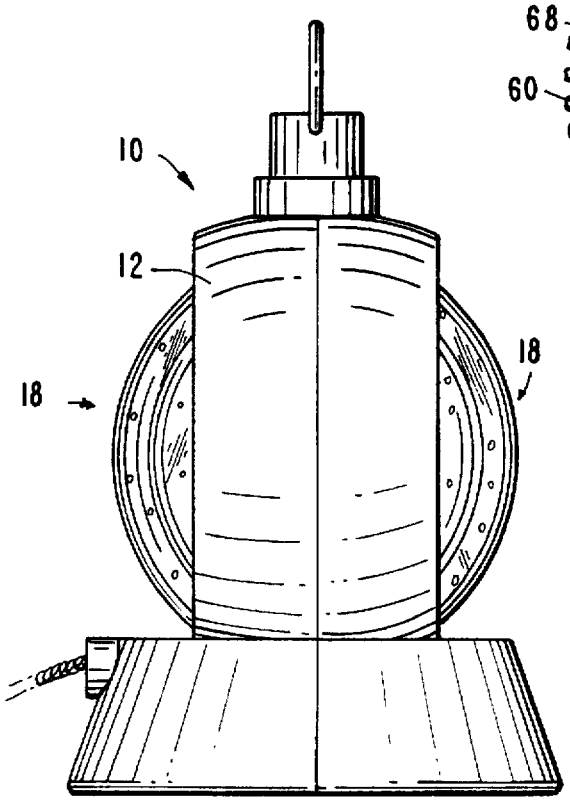
FIG. 10

DECORATIVE ARTICLE WITH FLAKE CIRCULATING MEANS

FIELD OF THE INVENTION

This invention relates generally to novelty display devices and, more particularly, to display devices simulating a continuous snowfall scene or the like.

DISCUSSION OF THE PRIOR ART

Novelty items and paperweights comprising decorative articles disposed in liquid filed containers having glitter or other simulated snow flakes therein are known in the art. U.S. Pat. No. 2,361,424 to Snyder, for example, discloses a figurine mounted within a liquid filled, transparent container. By shaking the container a white particulate matter dispersed in the liquid may be circulated within the container to simulate whirling snow around the figurine.

Decorative devices of the aforementioned type, typically in the shape of a sphere or dome, are generally static, that is, they contain no moving parts. In order to achieve the effect of a snowfall, the device must be manually shaken to agitate the liquid and the particles therein. A snowfall is simulated as the particles settle to the bottom. The effect, however, is short lived, and each successive "snowfall" requires agitating the device anew. Moreover, because the sphere or dome is completely filed with liquid, these decorative devices are somewhat heavy, even when miniaturized. As a consequence, they typically cannot be hung as ornaments as on the branch of a Christmas tree, and are easily broken when dropped.

To overcome the short lived nature of the snowfall, some decorative devices include a mechanism, such as a motor or a blade, to continuously circulate the liquid and the snowflake-simulating particles therein. While this imparts a dynamic effect to the device, the particles do not move in a realistic pattern from top to bottom as would occur in an actual snowfall. Rather, particle movement is multidirectional, thereby detracting from the desired aesthetic effect of a realistic snowfall. Additionally, dynamic devices of this type tend to be both mechanically complex and expensive to manufacture.

U.S. Pat. No. 5,313,727 to Murray discloses a dynamic display device which includes a transparent hollow dome containing a liquid having a plurality of small snowflake-simulating particles dispersed therein. The dome is open at the bottom and mounted on a base having a pumping chamber formed therein. The top of the pumping chamber, which defines the bottom of the dome, has an inlet and an outlet forming a flow path between the dome and the pumping chamber. The liquid and the particles therein are recirculated by a pump through the pumping chamber and into the dome via a vertically oriented transport tube. In this manner, the particles are transported to the top of the dome whereupon they fall by gravity to simulate a snowfall. To further enhance the aesthetic effect, a rotating figurine or other decorative object is positioned within the globe.

Although the decorative structure proposed by Murray is, in certain respects, an improvement over previously proposed devices of this type, it too has drawbacks. The mechanism for recirculating the liquid and dispersed particles is complex in that it requires a large number of integrally formed structural elements, moving parts, liquid tight seals, and diverse flow passages. Also, use of a pumping chamber requires a large base and necessitates using a greater volume of liquid than that required to fill the dome. As such, the Murray device is relatively bulky and heavy.

Lightweight decorative devices utilizing liquid filled double-walled transparent shells are also known in the art. In U.S. Pat. No. 5,261,848 to Kaplan et al., there is disclosed a toy which includes a base supporting a liquid-filled double walled transparent dome-shaped shell having the usual flake-like particles dispersed in the liquid. An ornamental figure is positioned inside the shell. The toy creates the illusion that the figure is submerged in the liquid, though in fact it is not. Although the Kaplan et al. device is lightweight, the housing must be shaken or otherwise agitated to induce movement of the particles suspended in the liquid.

A lightweight decorative device which utilizes air as the operating fluid and includes dynamic means for simulating a snowfall is disclosed by Hormann in U.S. Pat. No. 2,587,620. This device includes a stationary disk having a decorative scene on the front face thereof. The stationary disk is positioned at the back of a horizontally oriented rotating cylinder defining an air-filled compartment, and a plurality of blades secured to the cylinder extend into the compartment at various angles. A transparent member defines the front face of the cylinder. The cylinder is motor driven for rotation whereby flake-like particles disposed in the compartment are transported by the blades from the lower part of the compartment to the upper part thereof whereupon they are released across the entire width of the upper zone. Because air is utilized as the operating fluid, the particles used within the compartment are extremely lightweight, and variations in blade orientation are required to achieve the desired distribution of particles. Nor is this device as aesthetically pleasing as those wherein the flakes are dispersed in a liquid.

SUMMARY OF THE INVENTION

It is an object of the present invention to provide a decorative display device which provides a realistic simulation of a snowfall.

It is a further object of the present invention to provide a display device that not only provides an aesthetically pleasing effect, but also is reliable, durable, compact, mechanically simple in design, and inexpensive to manufacture.

It is a further object of the present invention to provide a decorative kinetic device which is lightweight and configurable, if desired, to hang from a relatively flaccid elevated support structure, such as a limb of a Christmas tree. The aforementioned objects, as well as others which will become apparent to those skilled in the art, are achieved by a display device that comprises a compartment including first and second opposed sidewalls defining a closed interior cavity having upper and lower zones. The sidewalls, or at least overlapping portions thereof, are transparent, and the cavity therebetween is filled with a substantially transparent liquid having flake-like particles dispersed therein. Recirculating means disposed within the cavity engage the flake-like particles for carrying them from the lower zone of the cavity to the upper zone thereof thereby continuously recirculating the flake-like particles within the liquid for simulating a snowfall.

While the preferred flake-like particles in accordance with the present invention are flat, thin, relatively small particles, which may be reflective, it should be understood that usage of the phrase "flake-like particles" herein is not intended to limit the particles to any particular size or shape, but rather to connote any particles suitable for dispersion in the liquid-filled compartment for recirculation thereabout by the recirculating means.

In one aspect of the invention, the recirculating means may include a plurality of blades, scoops or the like radially inwardly distributed at the periphery of the compartment and driven for rotation. As these blades, scoops, etc. rotate, they pick up flake-like particles at the lower zone of the cavity and recirculate them to the upper zone where they are dropped by the scoops to filter down through the liquid for creating the illusion of falling snow. In a modified embodiment, the scoops, blades, etc. may be dispensed with. In this modified embodiment, friction between the flake-like particles and the rotating periphery of the compartment is relied upon to recirculate the flake-like particles from the lower zone to the upper zone. For this purpose the periphery of the compartment may be roughened to enhance frictional engagement with the flake-like particles.

It should be understood, therefore, that as used herein the term "recirculating means" is intended to encompass any mechanism disposed at the periphery of the interior cavity and moveable thereabout relative to the liquid for engaging and carrying the flake-like particles from the lower zone to the upper zone to thereby continuously recirculate the flake-particles within the liquid. Similarly, any reference to "blades" or "blade-like members" should be understood as including any members projecting from the periphery of the compartment into the cavity for engaging the flake-like particles regardless of the size, shape or orientation of such members, and in particular it should be understood that references to "blades" or "blade-like members" is not intended to delimit the corresponding structure to a member having any particular shape.

In accordance with a presently preferred aspect of the invention, the entire compartment is rotatably driven, as by a motor, such that rotation of the compartment effects recirculation of the flake-like particles by the blades, scoops, roughened surface, etc. This embodiment enjoys the advantage that there is no necessity for a liquid seal that accommodates movement between the endwall and sidewalls of the compartment. The rotation axis is preferably, but not necessarily, substantially horizontal.

The liquid within the sealed cavity has a viscosity selected to achieve a gradual downward movement, due to gravity, of the flake-like particles after they have been delivered to the upper zone of the cavity by the recirculating means. Preferably, the liquid is a non-toxic solution having a composition more fully described hereinbelow.

The preferred display device of the present invention also includes an outer, preferably opaque, stationary shell having an opening therein for receiving the rotatable compartment. Preferably, the compartment is positioned for rotation within the outer shell such that the scoops, blades, etc. are concealed from view by a portion of the shell proximate the opening therein. An ornamental structure, such as a figurine, alone or in combination with a holiday scene or the like, is disposed in the shell in visual alignment with the transparent portions of the sidewalls of the compartment such that the ornamental structure may be viewed therethrough, thereby creating the visual effect that the ornamental structure is immersed in a liquid-filled shell. The ornamental structure within the shell may be driven for rotation, for example about a vertical axis, or for more complex motion. While particular structures are disclosed herein for moving the ornamental object, it will be appreciated that there are numerous other mechanisms for moving the object for the same or other motions than those described. It accordingly should be understood that the phrase "means for moving the ornamental structure" is intended to encompass all such mechanisms regardless of their mode of construction, and that for purposes of delimiting the present invention all such mechanisms are to be considered as equivalent to the one described herein.

In the presently preferred embodiment, the outer shell has a rounded exterior contour for simulating the appearance of a snow globe. For example, the outer shell may be substantially hemispherical, which term is intended to encompass not only a strictly hemispherical shape, but also intermediate structures which combine a hemispherical portion with other shapes such as cylindrical, frusto-conical, and the like. In this embodiment the outwardly facing sidewall of the compartment preferably has a substantially convex exterior contour having a radius of curvature which approximates the curvature of the outer shell, though this is not mandatory, and the outwardly facing sidewall may also be flat. If one or both of the sidewalls is convex, there is the additional advantage that the sidewalls function as a lens for magnifying the ornamental structure inside the shell.

In accordance with one illustrative embodiment of the present invention, the rotating means is configured as a single shaft electrical motor with suitable gearing for rotating the compartment about a substantially horizontal axis and the ornamental structure about a substantially vertical axis. The rotating means further includes a plurality of teeth radially arranged about an exterior surface of the compartment which engage a driving gear driven by the motor. Alternatively, the compartment may be driven for rotation by a driven belt or rubber friction roller acting on the periphery of the compartment, in which event the teeth on the compartment may be dispensed with. While a preferred mechanism for rotating the compartment is shown and described herein, those of ordinary skill in the art who have read this description will appreciate that there are numerous other mechanisms for rotating the compartment and, therefore, as used herein the phrase "rotating means for rotating the compartment" should be construed as including all such mechanisms as long as they achieve the desired result of rotating the compartment, and, therefore, that all such alternative mechanisms are to be considered as equivalent to the one described herein.

In any event, by properly selecting the viscosity of the liquid in the compartment, the rate of rotation of the recirculating means and by employing the region of the shell adjacent the opening therein to obscure from view both the scoops and the inevitable air bubble in the compartment, the illusion is created that snow is continuously falling inside the shell unaided by moving parts. This is so even in those embodiments wherein the compartment itself is rotated, as it has been demonstrated that except upon the closest inspection, viewers are unable to detect rotation of the transparent sidewalls even though they are, in fact, rotating. In the preferred embodiment a light is fixed in the shell for illuminating the interior thereof for enhancing the visual effect.

As indicated above, a display device constructed in accordance with the present invention may be configured as a snow globe. To facilitate support of such a configuration upon a planar support surface, the display device may be provided with a base configured to receive and support the shell thereon. Alternatively, the base may be integral with the shell. In either event, the motor/gear drive train may be disposed within the base.

Because only a small volume of liquid confined to the compartment is utilized to give the appearance of a much larger volume of liquid within the shell, a display device in accordance with the present invention may be sufficiently lightweight that it may be suspended from a somewhat flaccid support structure such as, for example, a limb of a Christmas tree. To facilitate such mounting, the outer shell may be provided with a hook or other fastening means securable to the support structure. Also, because of its lightweight construction, the display device of the invention will pass the industry "drop test" employed to test toys and the like for safety.

The display device of the invention is preferably powered by a DC motor electrically connected to a conventional AC outlet via a converter. Of course, the motor may also be battery driven. The present invention contemplates both a single display device or plural display devices electrically connected together in a manner well known in the art.

In a modified embodiment of the present invention, the aforementioned compartment is a first compartment, and the display device further comprises a second compartment constructed in an identical manner to the first and mounted in a second opening in the shell. The first and second compartments are preferably, though not necessarily, disposed at opposite sides of the outer shell. Like the first compartment, the transparent portions of the sidewalls of the second compartment may be mutually aligned with each other and the figurine or other ornamental structure such that the figurine may be viewed therethrough. Alternatively, the second compartment may be aligned with a different ornamental object disposed in the outer shell.

Other objects and features of the present invention will become apparent from the following detailed description considered in conjunction with the accompanying drawings. It is to be understood, however, that the drawings are intended solely for the purposes of illustration and not as a definition of the limits of the invention, for which reference should be made to the appended claims.

DETAILED DESCRIPTION OF THE DRAWINGS

In the drawings, wherein like reference characters denote similar elements throughout the several views:

FIG. 8 is a partial side elevational view, partly in cross-section, of a modified display device in accordance with the present invention;

FIG. 9 is a rear elevation view, partly in cross-section, of the embodiment of FIG. 8; and FIG. 10 is a side elevational view of another modified embodiment of a display device in accordance with the present invention.

DETAILED DESCRIPTION OF THE PRESENTLY PREFERRED EMBODIMENTS

Figure 1:
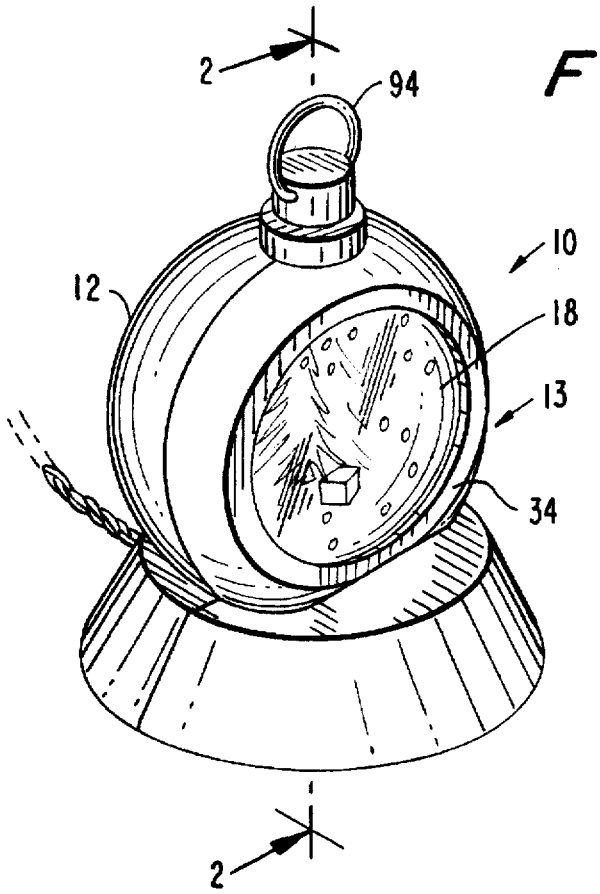
FIG. 1 is a perspective view of an illustrative embodiment of a display device constructed in accordance with the present invention.
Figure 2:
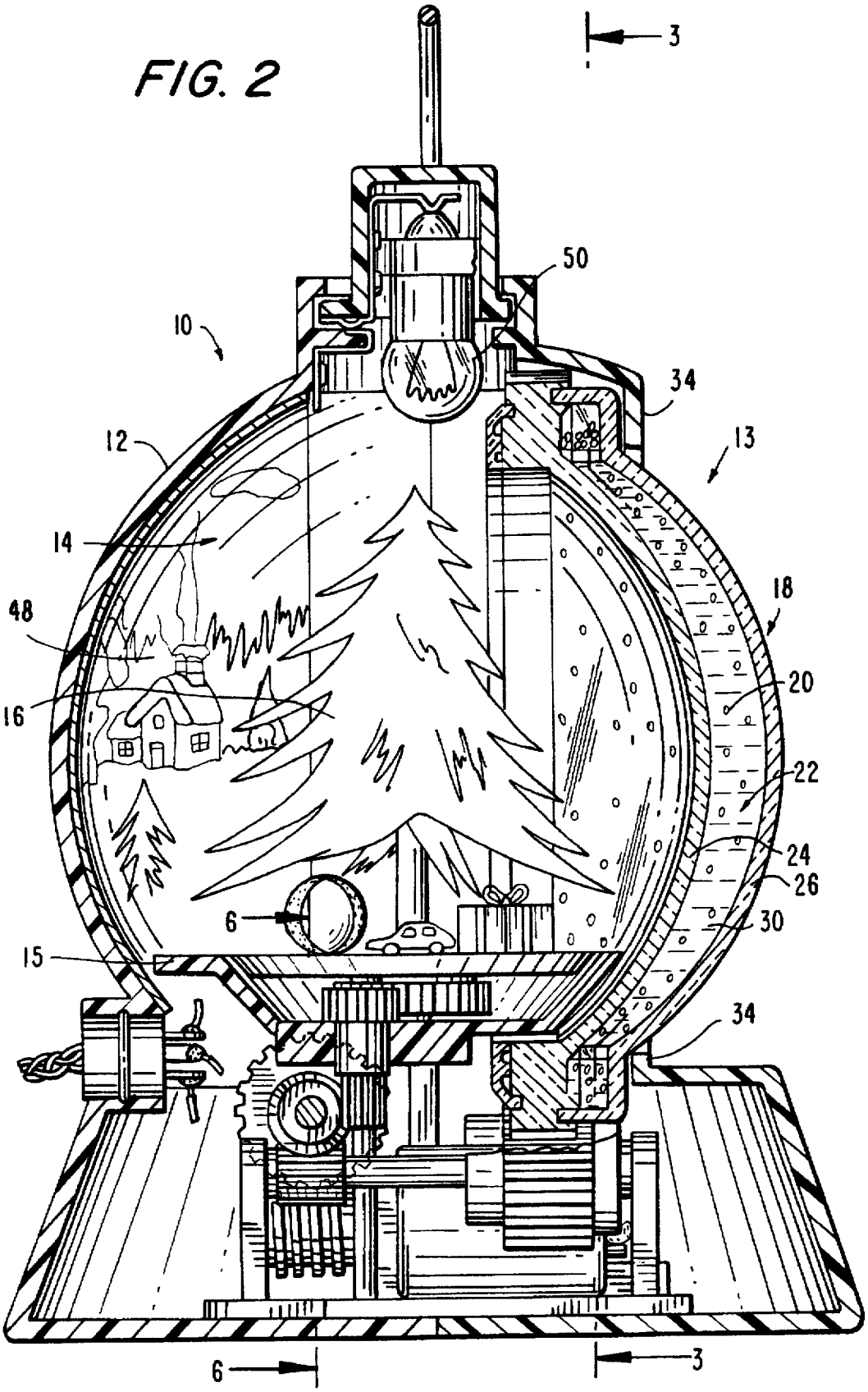
FIG. 2 is a cross-sectional view taken substantially along the line 2—2 in FIG. 1.

With initial reference to FIGS. 1 and 2, there is shown a display device 10 constructed in accordance with an illustrative embodiment of the present invention. As previously indicated, a principal object of the present invention is to provide a lightweight, decorative device simulating a snowfall. In the embodiment depicted, display device 10 is configured as a snow globe and includes an opaque exterior housing or shell 12 having an opening 13 at one end fitted with a liquid-filled substantially transparent compartment 18. Outer shell 12 and compartment 18 are preferably comprised of plastic and collectively define an interior space 14 for accommodating an ornamental object 16 which may be viewed through transparent compartment 18 as will be more fully apparent hereinafter.

With continued reference to FIGS. 1 and 2, compartment 18 includes substantially transparent inner and outer curved sidewall portions 24 and 26, respectively, in close spaced relation from each other and joined at their peripheries. To convey the appearance of a snow globe, outer shell 12 has a substantially hemispherical shape and outer curved sidewall portion 26 has a convex shape with a radius of curvature approximating that of shell 12. As depicted in FIG. 2, the inner curved sidewall portion 24 has a radius of curvature substantially matching that of sidewall portion 26 whereby the transparent sidewalls 24, 26 function as a lens for enhancing the visual effect of the display device 10 in a manner more fully described below. The sidewall portions 24, 26 define therebetween as interior cavity 22 filled with a liquid 30 having reflective flake-like particles 20 simulating snow dispersed therein.

Figure 4:
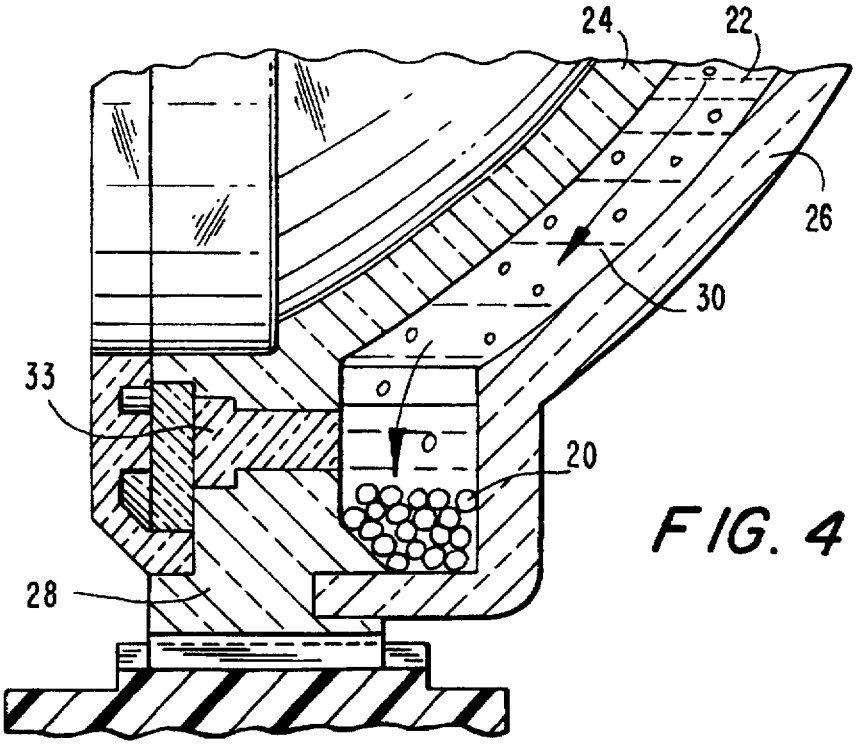
FIG. 4 is a cross-sectional view taken substantially along the line 4—4 in FIG. 3.
Figure 3:
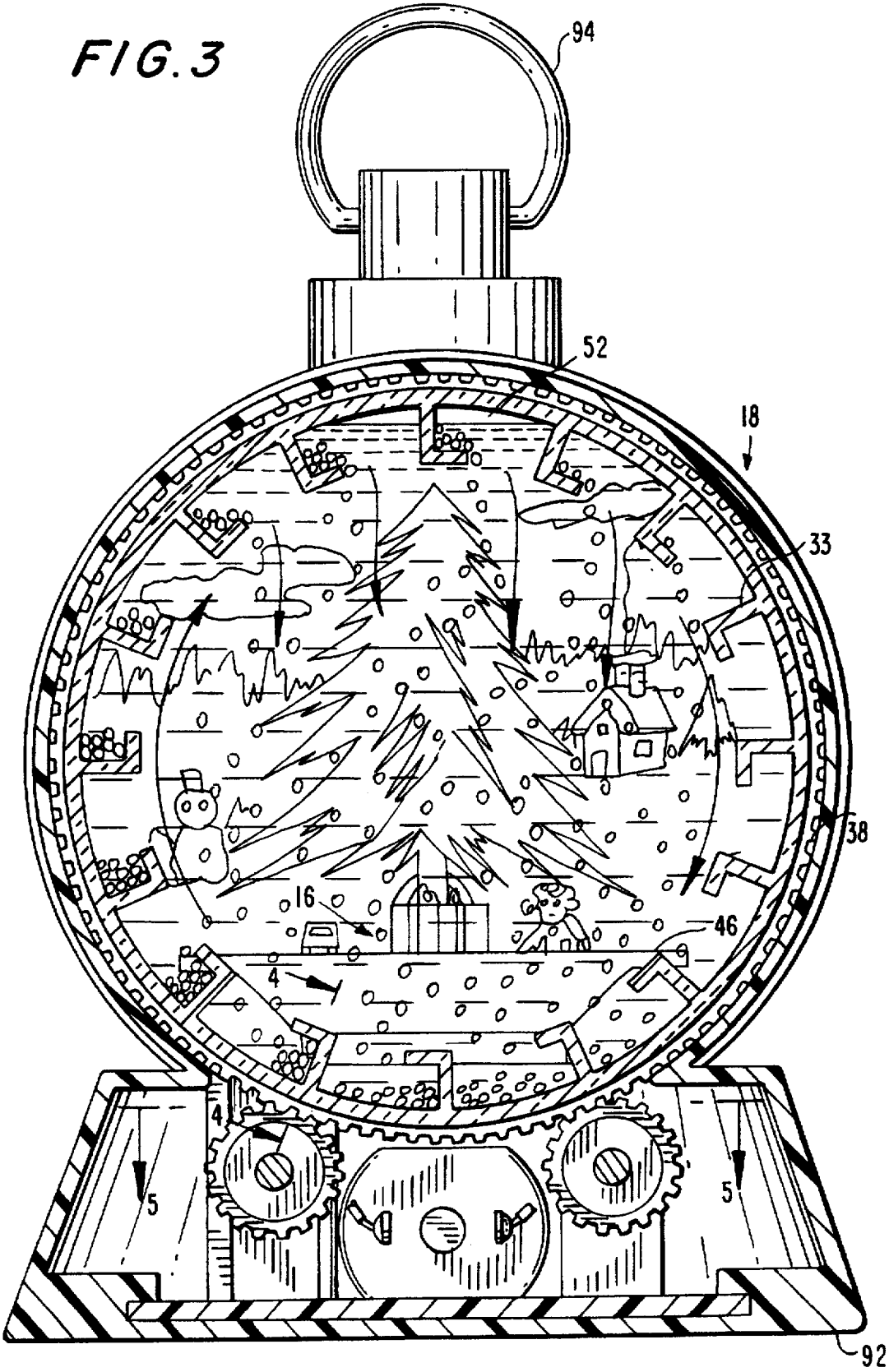
FIG. 3 is a cross-sectional view taken substantially along the line 3—3 in FIG. 1.

The compartment 18 is mounted for rotation in the opening 13 in shell 12. As best seen in FIGS. 2–4, the compartment 18 includes a peripheral endwall 28 between sidewall portions 24, 26 and a plurality of paddles, scoops or other blade-like members 33 are distributed about the endwall and project into the cavity 22. While endwall 28 is shown as a separate member, it will be appreciated that it may comprise an extension integral with one or the other of the sidewall portions 24, 26. Endwall 28 includes an opening (not shown) for filling compartment 18 with liquid 30 and particles 20, after which the hole may be plugged.

As will be more fully described hereinbelow, the compartment 18 is mounted for rotation about a substantially horizontal axis, such that as the scoops 33 are rotated from the bottom of the device 10 to the top thereof, they scoop up and carry with them flake-like particles 20 that have fallen to the bottom of interior cavity 22. These particles 20 are released as the scoops approach the upper portion of the device 10 whereupon the particles 20 fall through the liquid 30 in the cavity 22 to the bottom of the device 10, at which point the process is repeated. It will be appreciated that the exact point at which the particles 20 are released from the scoops 33 for descent through the liquid 30 will depend upon a number of factors, including the shape of the scoops, the viscosity of the liquid, and the size and shape of the flake-like particles 20. Preferably the scoops 33 are configured to release particles over a substantial arc distance at the upper portion of the cavity 22, thereby enhancing the visual illusion of a snowfall, and those of ordinary skill in the art will appreciate that the number of scoops 33, their positioning and angle of operation may be varied to achieve the desired effect.

As best seen in FIGS. 1 and 2, shell 12 includes a vertical annular wall or flange 34 defining the opening 13. Compartment 18 is seated in the opening 13 such that the peripheral portion thereof is obscured from view by the annular wall 34. Consequently, persons viewing the device 10 through the liquid-filled transparent compartment 18 cannot see the scoops 33 or any other components disposed radially outward therefrom. This further enhances the illusion of the snowfall, as viewers do not see the mechanism, i.e. scoops 33, for recirculating the flake-like particles 20. As best seen in FIGS. 2 and 3, a suitable background scene 48 may be painted on the rear interior wall of outer shell 12.

Figure 5:
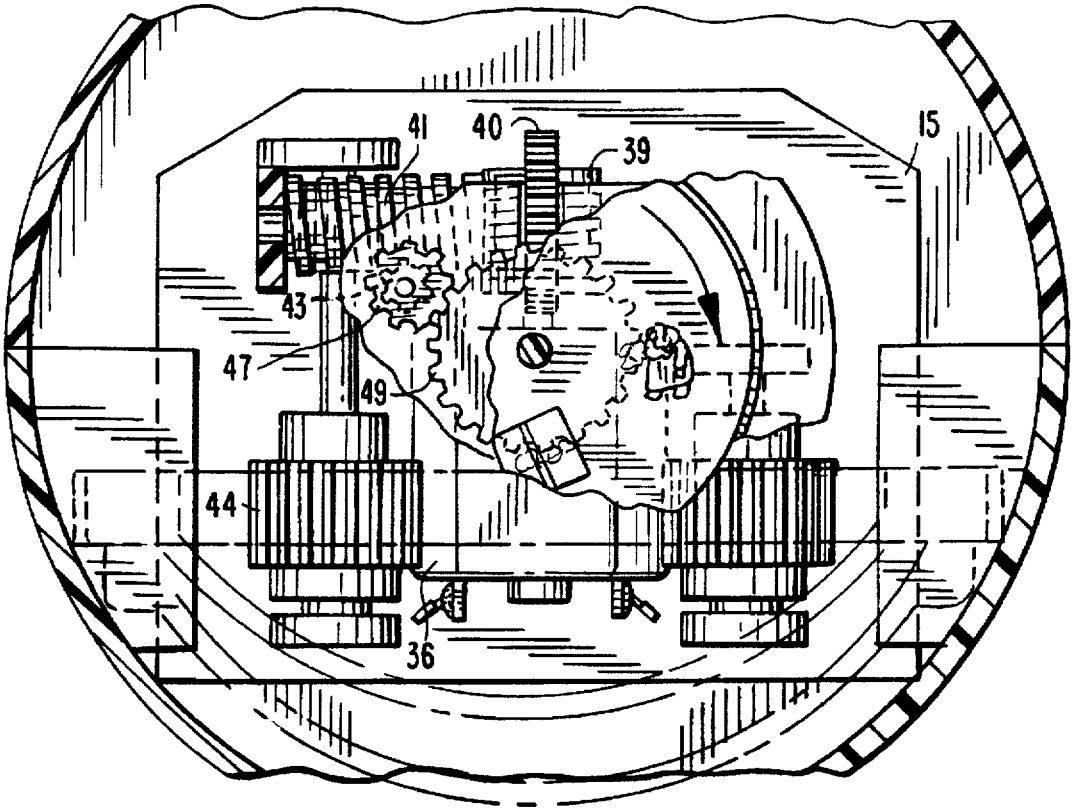
FIG. 5 is a cross-sectional view taken substantially along the line 5—5 in FIG. 3.
Figure 6:
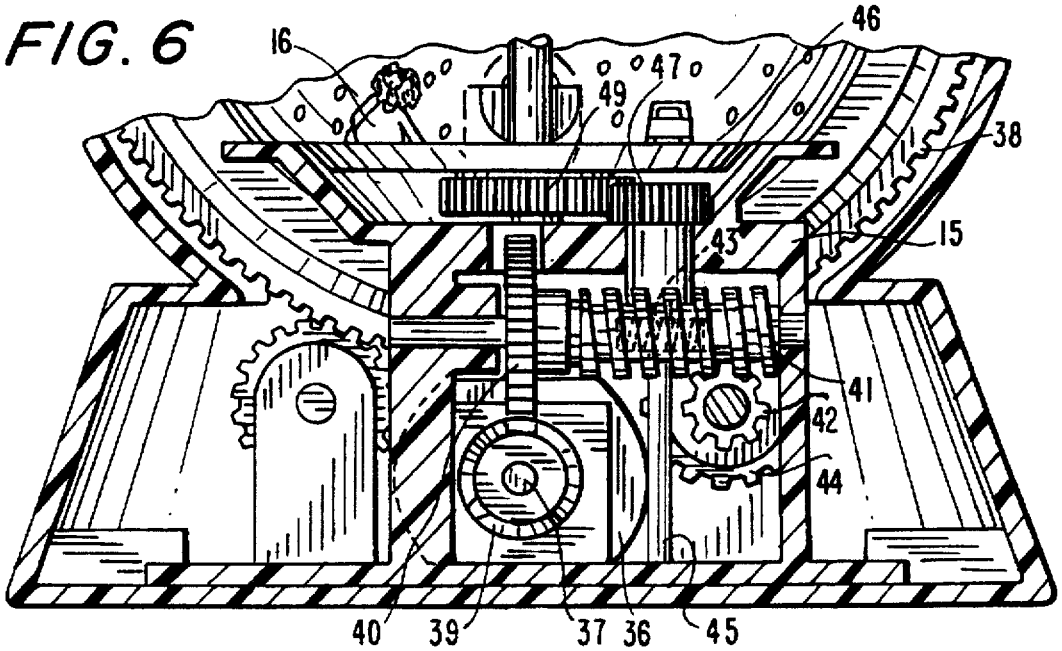
FIG. 6 is a cross-sectional view taken substantially along the line 6—6 in FIG. 2.

Referring now to FIGS. 5 and 6, the mechanism for effecting rotation of the compartment 18 about a horizontal axis will now be described. As shown, a DC motor 36 drives a shaft 37 and a first worm gear 39 secured to the shaft for rotation therewith. First worm gear 39 drives a gear 40 which, in turn, drives a second worm gear 41 secured to a common shaft with gear 40. Second worm gear 41 drives a gear 42 which, as shown, is secured to a common shaft with a gear 44 dimensioned for engagement with teeth 38 projecting radially outward from compartment 18 for rotatably driving the compartment 18 about its horizontal axis. Of course, the speed of rotation of compartment 18 about its horizontal axis may be controlled by a suitable selection of motor 36 and gears 39, 40, 41, 42 and 44. As depicted in FIGS. 5 and 6, the motor 36 and drive train for rotating compartment 18 are disposed in an opaque base 15 at the bottom of the device 10.

As best depicted in FIG. 6, motor 36 also drives the ornamental object 16, shown here as a Christmas tree and holiday presents, for rotation about its vertical axis. In the depicted embodiment ornamentsl object 16 comprises a base 46 having a Christmas tree and holiday presents secured thereon, though any suitable ornamental object will suffice. For rotating ornamental object 16, worm gear 41 also drives a gear 43 secured to a vertical shaft 45 for effecting rotation thereof. A gear 47 secured to the shaft 45 for rotation therewith drives a gear 49 secured to the base 46 of ornamental object 16 for rotatably driving the latter. It will be appreciated that the base 46 serves to obscure from view the gearing and motor therebeneath, and the upper surface of the base 46 may be painted or otherwise decorated to additionally serve an ornamentsl function. Alternatively, the base 46 may remain stationary as the Christmas tree rotates. As the manner in which the Christmas tree may be coupled to the motor 36 for accomplishing this objective is well within the capabilities of the person of ordinary skill in the art, a further description thereof is deemed unnecessary.

To enhance the illusion of a snowfall and to facilitate viewing of the decorative object 16 in the cavity 14, display device 10 preferably includes a conventional DC bulb 50 (FIG. 2) disposed in a cavity defined at an enlarged upper portion of the outer shell 12. It will be apparent that wiring connecting the power source to the motor 36 and bulb 50 may be hidden from view by snaking the wiring through the base 15 and along the periphery of the compartment 18, the latter being hidden from view by annular wall 34.

When display device 10 is activated, a viewer looking at the device 10 through the compartment 18 will see a simulated winter scene comprised of flake-like particles 20 falling through the liquid 30 in cavity 22, a rotating ornamental object 16 and a background scene 48. Because the cavity 22 between the transparent sidewall portions 24, 26 is filled with liquid, there is the illusion that the entire interior space 14 is filled with liquid and that the particles 20 are falling throughout the space 14. Moreover, the curvature of the sidewall portion 24, 26 functions as a lens to magnify the decorative object 16 in the space 14 thereby further enhancing the visual illusion.

Although the entire compartment 18 is rotating about its horizontal axis, the visual illusion created by the display device 10 is enhanced if rotation of the sidewalls 24, 26 is not detected by the viewer. It has been demonstrated with prototype devices in accordance with the present invention that matters may be arranged such that rotation of sidewalls 24, 26 about their horizontal axes is extremely difficult to detect. A variety of factors contribute to this illusion. First, and as noted above, the scoops 33 rotating at the periphery of the compartment 18 are obscured from view by the annular wall 34 of shell 12. Also important to this illusion is that the snowfall effect of particles 20 falling through the liquid 30 overwhelms the visual perception of rotation of the sidewalls 24, 26. This is achieved if compartment 18 rotates slowly relative to the speed at which the flake-like particles 20 fall through the liquid filled cavity 22, the latter being dependent on the viscosity of the liquid 30, the quantity, size and weight of the particles 20 and the number of scoops 33. In any event, once this description is known, persons of ordinary skill in the art will be capable of varying these parameters to achieve the visual illusion that the compartment 18 is not rotating.

It is difficult, if not impossible, to fill the cavity 22 between the sidewall portions 24, 26 without leaving an air bubble 52 therein (FIG. 3). In any event, an air bubble is desirable to accommodate thermal effects, i.e. expansion and contraction of the liquid 30 in the cavity 22 as a consequence of changing environmental temperature. On the other hand, if the air bubble is visible, it has an adverse impact on the aesthetic effect of the display device 10. Accordingly, and as shown in FIG. 2, the peripheral portion of the cavity 22 is enlarged such that it is sufficiently sized to accommodate the maximum expected air bubble, which is believed to occupy between about 2% and 10% of the volume of the cavity. It will be appreciated that this enlarged space at the periphery of the cavity 22 is, like the scoops 33, obscured from view by the annular wall 34. Normally, of course, the air bubble 52 will remain at the top of the liquid-filled cavity 22, and the scoops 33 will pass directly through the air bubble as the compartment 18 rotates. If the scoops were to drag any of the air in air bubble 52 downward with rotation of compartment 18, such air would escape upward through the liquid 30 as the scoops approached the lower portion of cavity 22. It is presently believed that this would also have an adverse impact on the visual effect desired for the device 10 as described hereinabove. To minimize this possibility, the scoops 33 do not occupy the full depth of the enlarged peripheral portion of the cavity 22 thereby allowing them to pass through the air bubble 52 without entrapping any air.

From the foregoing description, those of ordinary skill in the art will recognize that it is not mandatory that compartment 18 rotate about a horizontal axis, and that it could rotate about other axes as well. It is not even necessary that the sidewalls 24, 26 rotate at all. Instead, an endwall may be incorporated in the compartment 18 for rotation relative to stationary sidewalls 24, 26, with such endwall being provided with scoops, etc. as described hereinabove for recirculating the flake-like particles 20. The disadvantage of such an arrangement is the requirement of a liquid seal accommodating relative movement between the endwall and the sidewall portions 24, 26. For this reason, it is presently preferred and described hereinabove that the entire compartment 18 rotates relative to outer shell 12.

Figure 7A:
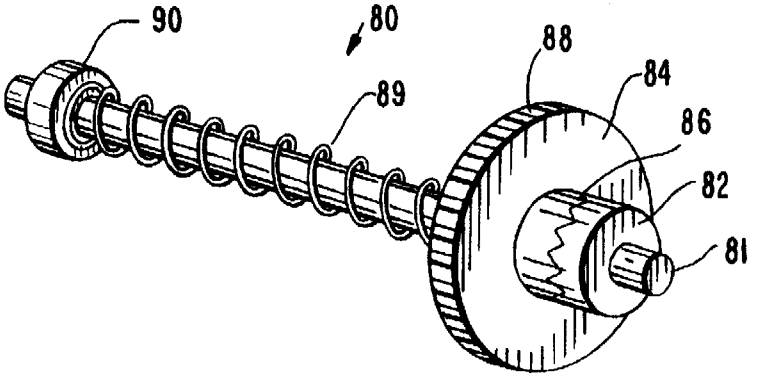
FIG. 7A is a perspective view of a clutch suitable for incorporation in the drive mechanism of the display device of FIG. 1.
Figure 7B:
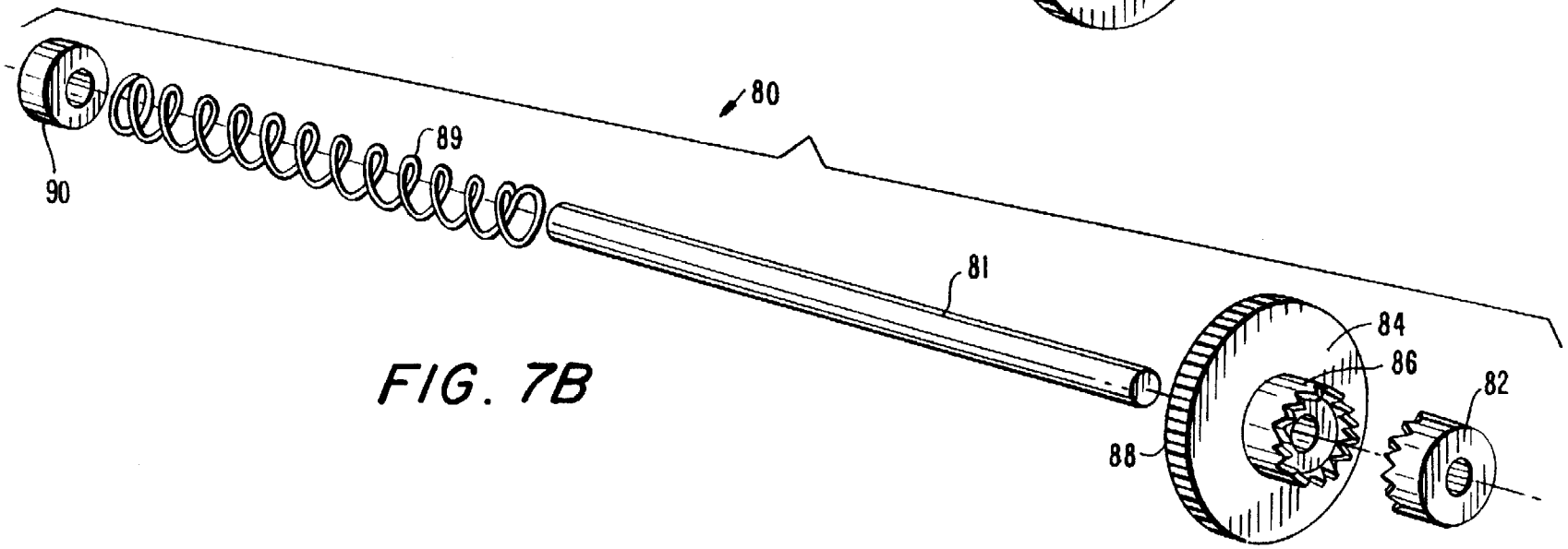
FIG. 7B is an exploded view of the clutch of FIG. 7A.

The present invention contemplates the possibility that someone may grab the outer sidewall 26 and hold it stationary relative to shell 12. In the absence of a protective mechanism, this could damage the gearing or other components in the display device 10. To preclude this possibility, and as best illustrated in FIG. 7A and 7B, the drive for compartment 18 may incorporate a clutch 80. As shown, clutch 80 includes a shaft 81 to which gear 44 (FIG. 5) may be secured for rotation therewith. A first saw tooth clutch gear 82 is also affixed to shaft for rotation therewith.

Clutch gear 82 is, in tun, driven by a drive gear 84 which replaces gear 42 in FIG. 6. Drive gear 84 includes a second saw tooth clutch gear 86 dimensioned for mating with first clutch gear 82 for driving clutch gear 82 and shaft 81 secured thereto. Gear 84 has external teeth 88 thereon for mating with worm gear 41 (FIG. 6) in the motor/gear drive train.

The axial hole in gear 84 is dimensioned for free rotation about the shaft 81 such that gear 84 only drives gear 82 and shaft 81 when clutch gears 82 and 86 are engaged. Under normal operating conditions, clutch gear 86 is urged into engagement with clutch gear 82 by compression spring 89 disposed about shaft 81 and urged against gear 84 by a spring retainer 90 secured on shaft 81. It will be appreciated, however, that if compartment 18 becomes jammed or is otherwise blocked from movement, gear 44, and hence clutch gear 82 and shaft 81, will stop rotating. In such event gear 84, which is driven by the motor/gear drive train, will slip out of engagement with gear 82 against the compression force of spring 89, thereby allowing gear 84 to rotate independently of gear 82.

Although those of ordinary skill in the art will appreciate that the composition of the liquid 30 within the cavity 22 may vary, one suitable composition comprises, by weight, 37.3% propylene glycol, 0.1% surfactant, 0.2% fungicide/disinfectant and 62.4% pure water. In this embodiment, the flake-like particles 20 comprise 0.194 grams of artificial snow and 0.194 grams of glitter. The propylene glycol is preferably propylene glycol USP, as manufactured, for example, by Dow Chemical Corporation, though plain propylene glycol may be suitable. The surfactant may be surfactant PE 6200 as manufactured by BASF under the trade name Pluronic L62. The fungicide/disinfectant may comprise U-13 as manufactured by Induchem AG and distributed in the United States by Lipo Chemicals, Paterson, N.J. As noted, the weight percentages of the various components may be varied, and in another formulation the propylene glycol comprises, by weight, 45%, the surfactant 0.2%, the fungicide/disinfectant 0.2% and pure water 54.6%. The flake-like particles 20 may comprise polystyrene or acrylic plastic, and their weight may likewise be varied within relatively broad ranges.

While it is presently preferred that scoops 33 or the like be employed to recirculate the flake-like particles 20 from the bottom of the cavity 22 to the upper portion thereof, this may not be necessary. Instead, it is possible to rely on frictional engagement between the flake-like particles 20 and the interior endwall of the compartment 18 to drag the particles 20 from the lower region of cavity 22 to the upper region thereof, whereupon gravity dislodges the particles from the endwall for traverse through the liquid 30 for simulating a snowfall. If this option is employed, the interior endwall may be roughened to enhance frictional engagement with particles 20.

In a further modification, the display device may be modified to simulate an underwater scene replete with bubbles. In this embodiment, the scoops may be intentionally configured to drag air from the air bubble 52 at the top of the cavity 22 down to the bottom thereof whereupon the air released from the scoops will filter up through the cavity as small air bubbles for creating an underwater effect. In this embodiment, the decorative object 16 may comprise one or more fish for providing a visual effect of fish in a bubbling underwater environment.

As best depicted in FIG. 3, each device 10 is preferably configured with a flat bottom 92 such that the devices 10 may be positioned on a fireplace mantel or other horizontal surface. In addition, each device 10 is preferably provided with a hook 94 or other fastening means secured to the top of the shell 12 such that the devices 10 may be hung from a suitable support structure. Because only the cavity 22 in the compartment 18 is filed with liquid 30, display device 10 is relatively lightweight and therefore suitable for hanging from a somewhat flaccid support structure, and particularly the limb of a Christmas tree. Those of ordinary skill in the art will appreciate that a plurality of the devices 10 may be strung together by a single wire pair in a manner well known in the art of Christmas tree decorations.

While the outer shell 12 is preferably hemispherically shaped as described hereinabove, this is not necessary, and the wall of shell 12 opposite compartment 18 may be substantially flattened to accommodate hanging the device 10 on a wall or other vertical surface.

Referring now to FIGS. 8 and 9, an alternative mechanism is illustrated for moving the decorative object 16. In particular, the mechanism illustrated in FIGS. 8 and 9 effects oscillation of the object 16 within the space 14. As shown, movement of the object 16 is effected by a cam and follower 60 driven by a gear 62. An object retaining member 64 interconnects rod 66 of the cam and follower 60 with the ornamental object 16 (not shown). The desired range of oscillatory movement of the object is governed by a vertical plate 68 having an arcuate slot 70 therein through which object retaining member 64 projects. It will be appreciated that a suitable display scene may be depicted on the face of vertical plate 68 facing compartment 18.

Still other modifications will suggest themselves to those of ordinary skill in the art who have read this description. For example, as depicted in FIG. 10 display device 10 may be fitted with two compartments 18 positioned, for example, on either side of the shell 12. This embodiment permits the decorative object 16 to be viewed from either side of the display device 10. As the manner in which an additional compartment 18 may be incorporated in the display device 10 for operation in the manner described hereinabove will be readily apparent to those of ordinary skill in the art, a further description thereof is deemed unnecessary.

Also, while a particular configuration for the display device 10 is depicted in the drawings and modifications thereto suggested hereinabove, still other configurations are feasible. Particularly, because the present invention employs a relatively thin liquid-filled cavity 22, which simulates a much larger volume of liquid, a variety of different shapes of lightweight Christmas ornaments may be fabricated in which a liquid-filled compartment is rotated by a small battery driven motor within a housing securable to a Christmas tree or the like by a hook or other fastening means. Similarly, novel pendants, brooches and other articles of jewelry may be Constructed utilizing a liquid-filled compartment rotated within a suitable housing. In those embodiments where the decorative object 16 is dispensed with, the rearmost of the sidewalls 24, 26 need not be transparent and may, instead, have a decorative scene on the side thereof facing cavity 22.

Since these as well as other changes and modifications will suggest themselves to those of ordinary skill in the art, and all such changes and modifications are intended to be within the scope of the invention, the above description should be considered as illustrative and not in a limiting sense, with the scope of the invention being defined by the following claims.

What is claimed is:

1. A display device comprising:

a compartment including first and second opposed sidewalls defining a sealed interior cavity therebetween having an upper zone, a lower zone and a periphery, at least a portion of each of said sidewalls being transparent, with said transparent portions in visual alignment;

a substantially transparent liquid disposed within said interior cavity and having a plurality of flake-like particles dispersed therein;

recirculating means disposed at said, periphery of said interior cavity and secured to said compartment for movement therewith;

rotating means for rotating said compartment and said recirculating means secured thereto for engaging and carrying said flake-like particles from said lower zone to said upper zone to thereby continuously recirculate said flake-like particles within said liquid; and a shell having an opening receiving said compartment and defining an interior space viewable through said visually aligned transparent portions of said sidewalls.

2. The display device according to claim 1, wherein said recirculating means includes a plurality of blade-like members radially distributed at the periphery of said interior cavity and projecting therein.

3. The display device according to claim 1, wherein said recirculating means comprises a surface for frictionally engaging said flake-like particles.

4. The display device according to claim 1, wherein said one sidewall has a substantially convex exterior contour.

5. The display device according to claim 1, further comprising an ornamental structure disposed in said interior space and visually aligned with the transparent portions of said sidewalls for viewing said ornamental structure therethrough.

6. The display device according to claim 5, wherein said ornamental structure comprises a figurine.

7. The display device according to claim 5, further comprising moving means for moving said ornamental structure for simulating animation thereof.

8. The device according to claim 7, wherein said rotating means and said moving means comprises a motor.

9. The display device according to claim 8, wherein said motor rotates said compartment about a substantially horizontal axis and rotates said ornamental structure about a substantially vertical axis.

10. The display device according to claim 8, wherein said means for rotating said compartment includes a plurality of teeth radially arranged about an exterior surface of said compartment and a driven gear engaging said teeth.

11. The display device of claim 10, wherein a portion of said shell proximate said opening obscures said recirculating means and said teeth from view.

12. The display device of claim 11, wherein said liquid has an air bubble therein and wherein said compartment defines an enlarged peripheral portion disposed behind said portion of said shell for obscuring said air bubble from view.

13. The display device according to claim 5, further comprising illuminating means positioned within said shell for illuminating said ornamental structure.

14. The display device according to claim 1, wherein said outer shell has a substantially hemispherical shape.

15. The display device according to claim 14, wherein said first sidewall has a substantially convex contour.

16. The display device according to claim 15, wherein said second sidewall has a substantially convex contour.

17. The display device according to claim 1, wherein said means for rotating said compartment includes a plurality of teeth radially arranged about an exterior surface of said compartment and a driven gear engaging said teeth.

18. The display device of claim 1, wherein a portion of said shell proximate said opening obscures said recirculating means from view.

19. The display device of claim 18, wherein said liquid has an air bubble therein and wherein said compartment defines an enlarged peripheral portion disposed behind said portion of said shell for obscuring said air bubble from view.

20. The display device according to claim 1, further comprising at least one of a base for supporting said shell on an underlying planar support surface and a hook means attachable to said shell for suspending said display device from an elevated support structure.

21. A display device comprising:

a compartment including:

first and second opposed sidewalls defining a sealed interior cavity therebetween having an upper zone and a lower zone, at least a portion of each of said sidewalls being transparent;

a substantially transparent liquid disposed within said interior cavity and having a plurality of flake-like particles dispersed therein; and recirculating means engageable with said flake-like particles for recirculating said flake-like particles within said interior cavity;

rotating means for rotating said compartment for effecting engagement between said recirculating means and said flake-like particles for moving said flake-like particles from said lower zone to said upper zone;

a housing defining an interior space and having an opening receiving said compartment, respective transparent portions of said compartment being viewable from outside said housing; and an ornamental structure positioned within said interior space and exterior to said interior cavity, said ornamental structure being visually aligned with said transparent portions of said sidewalls such that recirculation of said flake-like particles upon rotation of said compartment simulates falling of said flake-like particles over said ornamental structure.

22. The device according to claim 21, further including a base for supporting said housing on an underlying planar support surface.

23. The display device according to claim 21, further including hook means attachable to said housing for suspending said display device from an elevated support structure.

24. The display device according to claim 21, further including a bulb displayed in said interior space for illumination thereof.

25. The display device according to claim 21, wherein said compartment is a first compartment, said device further comprising:

said housing having a second opening;

a second compartment received within said second opening and including third and fourth opposed sidewalls defining a second sealed interior cavity therebetween having an upper zone and a lower zone, at least a portion of said third and fourth sidewalls being transparent;

a substantially transparent liquid disposed within said second interior cavity and having a plurality of flake-like particles dispersed therein; and second recirculating means engageable with said flake-like particles in said second interior cavity for recirculating said flake-like particles within said second compartment, and wherein said rotating means rotates said first and second compartments.

26. The display device according to claim 21, wherein said rotating means further comprises means for moving said ornamental structure within said housing.

* * * * *